US005957223A

United States Patent [19]

Doster et al.

[11] Patent Number: 5,957,223

[45] Date of Patent: Sep. 28, 1999

[54] BI-CENTER DRILL BIT WITH ENHANCED STABILIZING FEATURES

[75] Inventors: Michael L. Doster, Spring; Jack T. Oldham, Willis, both of Tex.

[73] Assignee: Baker Hughes Incorporated, Houston, Tex.

[21] Appl. No.: 08/811,581

[22] Filed: Mar. 5, 1997

[51] Int. Cl.[6] ..... E21B 10/26

[52] U.S. Cl. ..... 175/57; 175/385; 175/399; 175/408

[58] Field of Search ..... 175/398, 399, 175/57, 385, 406, 408

[56] References Cited

U.S. PATENT DOCUMENTS

| | | | |
|---|---|---|---|
| 1,769,921 | 7/1930 | Hansen . | |
| 1,959,368 | 5/1934 | Kennedye . | |
| 2,045,629 | 6/1936 | Betti . | |
| 2,308,147 | 1/1943 | Ballagh . | |
| 2,671,641 | 3/1954 | Hinkle . | |
| 2,715,552 | 8/1955 | Lane . | |
| 2,877,062 | 3/1959 | Hall et al. . | |
| 3,588,199 | 6/1971 | Hopmans . | |
| 3,851,719 | 12/1974 | Thompson et al. | 175/406 |
| 3,942,824 | 3/1976 | Sable . | |
| 4,080,010 | 3/1978 | Young . | |
| 4,580,642 | 4/1986 | Gosch . | |
| 4,600,063 | 7/1986 | Beasley . | |
| 4,610,307 | 9/1986 | Jurgens et al. . | |
| 4,630,690 | 12/1986 | Beasley et al. . | |
| 4,698,794 | 10/1987 | Kruger et al. . | |
| 4,729,438 | 3/1988 | Walker et al. . | |
| 4,739,842 | 4/1988 | Kruger et al. . | |
| 4,807,708 | 2/1989 | Forrest et al. . | |

(List continued on next page.)

OTHER PUBLICATIONS

Casto, Robert G., et al., "Use of Bicenter PDC Bit reduces Drilling Cost," Nov. 13, 1995, *Oil and Gas Journal*, pp. 92–96.

Csonka, G., et al., "Ream While Drilling Technology Applied Successfully Offshore Australia," Oct. 1996, *SPE International*, pp. 271–278.

Le Blanc, "Reaming–While–Drilling Keys Effort to Reduce Tripping of Long Drillstrings," Apr. 1996, *Offshore*, pp. 30–32.

Myhre, K., "Application of Bicenter Bits in Well–Deepening Operations," Mar. 2, 1990, *SPE International*, pp. 131–137.

Rothe, Jorge Rodriquez, "Ream–While–Drilling Tool Cuts Costs of Three Venezulean Wells," Jan. 13, 1997, *Oil and Gas Journal*, pp. 33–40.

Sketchler, B.C. "New Bi–Center Technology Proves Effective in Slim Hole Horizontal Well," Mar. 2, 1995, *SPE International*, pp. 559–567.

Warren, T.M., "Simultaneous Drilling and Reaming with Fixed Blade Reamers," Oct. 22, 1995, *SPE International*, pp. 1–11.

*Primary Examiner*—Hoang C. Dang
*Attorney, Agent, or Firm*—Trask, Britt & Rossa

[57] ABSTRACT

A method and apparatus for reaming or enlarging a borehole using a bi-center bit with a stability-enhanced design. The cutters on the pilot bit section of the bi-center bit are placed and oriented to generate a lateral force vector longitudinally offset from, but substantially radially aligned with, the much larger lateral force vector generated by the reamer bit section. These two aligned force vectors thus tend to press the bit in the same lateral direction (which moves relative to the borehole sidewall as the bit rotates) along its entire longitudinal extent so that a single circumferential area of the pilot bit section gage rides against the sidewall of the pilot borehole, resulting in a reduced tendency for the bit to cock or tilt with respect to the axis of the borehole. Further, the pilot bit section includes enhanced gage pad area to accommodate this highly-focused lateral loading, particularly that attributable to the dominant force vector generated by the reamer bit section, so that the pilot borehole remains in-gage and round in configuration, providing a consistent longitudinal axis for the reamer bit section to follow.

34 Claims, 4 Drawing Sheets

U.S. PATENT DOCUMENTS

| | | | |
|---|---|---|---|
| 4,817,740 | 4/1989 | Beimgraben . | |
| 4,854,403 | 8/1989 | Ostertag et al. . | |
| 4,984,633 | 1/1991 | Langer et al. . | |
| 5,050,692 | 9/1991 | Beimgraben . | |
| 5,094,304 | 3/1992 | Briggs . | |
| 5,099,931 | 3/1992 | Krueger et al. . | |
| 5,099,934 | 3/1992 | Barr | 175/393 |
| 5,150,757 | 9/1992 | Nunley . | |
| 5,180,021 | 1/1993 | Champion et al. . | |
| 5,222,565 | 6/1993 | Collinsworth . | |
| 5,307,885 | 5/1994 | Kuwana et al. . | |
| 5,363,931 | 11/1994 | Moriarty . | |
| 5,402,856 | 4/1995 | Warren et al. | 175/57 |
| 5,423,389 | 6/1995 | Warren et al. | 175/75 |
| 5,437,342 | 8/1995 | Powada . | |
| 5,465,759 | 11/1995 | Carlson et al. . | |
| 5,474,143 | 12/1995 | Majkovic . | |
| 5,495,899 | 3/1996 | Pastusek et al. . | |
| 5,497,842 | 3/1996 | Pastusek et al. . | |
| 5,522,467 | 6/1996 | Stevens et al. . | |
| 5,542,454 | 8/1996 | Carlson et al. . | |
| 5,601,151 | 2/1997 | Warren | 175/75 |
| 5,678,644 | 10/1997 | Fielder . | |
| 5,765,653 | 6/1998 | Doster et al. | 175/75 |

BI-CENTER DRILL BIT WITH ENHANCED STABILIZING FEATURES

BACKGROUND OF THE INVENTION

1. Field of the Invention

The present invention relates generally to enlarging the diameter of a subterranean borehole and, more specifically, to enlarging the borehole below a portion thereof which remains at a lesser diameter. The method and apparatus of the present invention effects such enlargement using a stability-enhanced bi-center bit.

2. State of the Art

It is known to employ both eccentric and bi-center bits to enlarge a borehole below a tight or undersized portion thereof.

An eccentric bit includes a pilot section, above which (as the bit is oriented in the borehole) lies an eccentrically laterally extended or enlarged cutting portion which, when the bit is rotated about its axis, produces an enlarged borehole. An example of an eccentric bit is disclosed in U.S. Pat. No. 4,635,738.

A bi-center bit assembly employs two longitudinally-superimposed bit sections with laterally offset axes. The first axis is the center of the pass-through diameter, that is, the diameter of the smallest borehole the bit will pass through. This axis may be referred to as the pass-through axis. The second axis is the axis of the hole cut as the bit is rotated. This axis may be referred to as the drilling axis. There is usually a first, lower and smaller diameter pilot bit section employed to commence the drilling and establish the drilling axis. Rotation of the bit remains centered about the drilling axis as the second, upper and larger radius main, or reamer, bit section extending beyond the pilot bit section diameter to one side of the bit engages the formation to enlarge the borehole. The rotational axis of the bit assembly then rapidly transitions from the pass-through axis to the drilling axis when the full diameter or "gage" borehole is drilled.

Rather than employing a one-piece drilling structure, such as an eccentric bit or a bi-center bit, to enlarge a borehole below a constricted or reduced-diameter segment, it is known to employ an extended bottomhole assembly (extended bi-center assembly) with a pilot bit at the distal end thereof and a reamer assembly some distance above. This arrangement permits the use of any standard bit type, be it a rock bit or a drag bit, as the pilot bit, and the extended nature of the assembly permits greater string flexibility when passing through tight spots in the borehole as well as the opportunity to effectively stabilize the pilot bit so that the pilot hole and the following reamer will take the path intended for the borehole. The assignee of the present invention has designed as reaming structures so-called "reamer wings" which generally comprise a tubular body having a fishing neck with a threaded connection at the top thereof and a tong die surface at the bottom thereof, also with a threaded connection. The upper mid-portion of the reamer wing includes one or more longitudinally-extending blades projecting generally radially outwardly from the tubular body, the outer edges of the blades carrying superabrasive (also termed "superhard") cutting elements, commonly termed PDC's (for Polycrystalline Diamond Compacts). The lower mid-portion of the reamer wing may include a stabilizing pad having an arcuate exterior surface the same or slightly smaller than the radius of the pilot hole on the exterior of the tubular body and longitudinally below the blades. The stabilizer pad is characteristically placed on the opposite side of the body with respect to the reamer wing blades so that the reamer wing will ride on the pad due to the resultant force vector generated by the cutting of the blade or blades as the enlarged borehole is cut. U.S. Pat. No. 5,497,842, assigned to the assignee of the present invention and incorporated herein for all purposes by this reference, is exemplary of such reamer wing designs. U.S. Pat. No. 5,765,653, also assigned to the assignee of the present invention and incorporated herein for all purposes by this reference, discloses and claims more recent improvements in reamer wings and bottomhole assemblies for use therewith, particularly with regard to stabilizing reamer wings and bottomhole assemblies.

As one might suspect from the foregoing descriptions of their respective structures, bi-center bits are more compact, easier to handle for a given hole size, more suitable for directional drilling bottomhole assemblies (particularly those drilling so-called "short" and "medium" radius non-linear borehole sections), and also less expensive to fabricate than reamer wing assemblies. However, stability of bi-center drill bits remains a significant, recognized problem.

For example, an *Oil & Gas Journal* article entitled "Use of bi-center PDC bit reduces drilling cost," Nov. 13, 1995, pp. 92–96, notes that the bi-center bit is impossible to "stabilize fully because the largest stabilizer size that can be used is the pass-through diameter, not the hole diameter". Further, the article notes that the bi-center bit is an unstable design due to the high loading on the pilot bit cutters opposite the reaming cutters (those on the main or reamer bit section), which are all located on one side of the hole. The result of these inadequacies is demonstrated (as noted in the aforementioned article) by an unacceptably severe tendency of these prior art bi-center bits to drill off their intended paths, or "walk," in a particular direction, resulting in a "dogleg" in the borehole, particularly undesirable in high precision, state-of-the-art directional and navigational well drilling.

Prior art bi-center bits, due to the above-noted imbalanced loading, also tend to exhibit the well-recognized phenomenon of bit "whirl," wherein a drill bit rotates or "whirls" about a center point offset from the geometric center of the bit in such a manner that the bit tends to precess or rotate backwards (opposite the direction of drill string rotation) about the borehole. One approach to alleviate bit whirl in conventional bits is to attempt to perfectly balance the radial and tangential cutter forces to achieve a laterally-balanced bit, as disclosed in U.S. Pat. No. 4,815,342. This approach will obviously not work with a bi-center bit due to the overwhelming dominance of the imbalanced side forces generated by the reamer bit section. Another approach, disclosed in U.S. Pat. No. 5,010,789, has been to intentionally imbalance the radial and tangential cutter forces of a conventional bit to direct a resultant force vector to one side of the bit, which side includes a bearing surface pushed by the force vector into substantially constant contact with the sidewall of the borehole. A variation of this approach has been used to stabilize reamer wing bottomhole assemblies, as disclosed in the above-referenced, commonly-assigned '842 and '653 patent, wherein a discrete stabilizer pad has been placed immediately below and opposite the blades of the reamer wing. However, the longitudinally compact configuration of bi-center bits also renders the discrete stabilizer pad approach unworkable, there being no location on the bit suitable for placement of such a structure.

The inventors herein have reflected at length on the instability problems of bi-center bits, and concluded that the aforementioned loading problem is not strictly the result of the placement of cutters on the reamer bit section, but of the relative, drastically misaligned orientations and difference in relative magnitudes of the composite or resultant radial force vector generated by the group of cutters on the pilot bit section in comparison to the radial force vector generated by the group of cutters on the reamer bit section. Such misalignment causes the bi-center bit to tilt or cock in the borehole, as the longitudinally offset, radially misaligned force vectors augment each other, driving the bit away from a desirable orientation wherein the longitudinal axis of the bit and that of the borehole are coincident, or, at the least, mutually parallel with an extremely small lateral offset. To further explain the problem, reference is made to FIG. 1 of the drawings, wherein an exemplary prior art bi-center bit 10 is schematically depicted in borehole B. The resultant radial force vector $F_1$ of the pilot bit section 12 is directed to the right of the page, while the longitudinally-offset resultant radial force vector $F_2$ of the reamer bit section 14 is directed to the left of the page, the two force vectors thus tending to cock or tilt the bit about a horizontal axis of rotation A lying between the pilot bit and reamer bit sections. The relatively large, highly directional resultant force vector $F_2$ generated by the reamer bit section cutters also contributes to instability problems in prior art bi-center bits, as such bits employ gages 16 having inadequate surface area radially opposing force vector $F_2$ to maintain the pilot bit section 12 in a stable position concentric with an ideal longitudinal axis L of the borehole, and thus the bi-center bit tends to drill an oversize and out-of-round pilot borehole PB which the reamer bit section follows, drilling an undersized reamed hole.

Existence of the above-mentioned dominant force vector $F_2$ has been previously recognized, and solutions to bi-center bit imbalance proposed, in SPE/IADC Paper No. 29396, "New Bi-Center Technology Proves Effective in Slim Hole Horizontal Well". However, one part of the proposed solution involved developing a greater imbalance in the lateral force vector $F_1$ of the pilot bit and to direct it in opposition to that of vector $F_2$, as shown in FIG. 1. As noted above, the inventors herein have recognized that such radially opposed forces actually exacerbate the imbalance problem and promote tilting or cocking of the bit in the borehole.

Thus, given the noted deficiencies of prior art attempts to reduce bi-center bit imbalance, there remains a need for a bi-center bit affording a high degree of stability, so that the otherwise advantageous characteristics of this type of bit design may be fully utilized.

SUMMARY OF THE INVENTION

The present invention provides a bi-center bit with stability-enhancing features included therein. Specifically, the bi-center bit of the present invention is designed from a cutter placement and orientation standpoint to place the resultant lateral or radial force vectors $F_1$ and $F_2$ in substantial mutual directional alignment transverse to the longitudinal bit axis, so that these longitudinally separated vectors both tend to force a side of the bit radially opposite these vectors against the borehole wall. Toward that end, cutter placement and orientation (siderake and backrake) on the pilot bit section are manipulated to cause the direction of force vector $F_1$ to generally coincide with the direction of dominant force vector $F_2$ generated by cutters of the eccentrically-placed blades of the reamer bit section. Ideally, force vectors $F_1$ and $F_2$ are substantially identical, or superimposed, in direction. The pilot bit section cutters may also be placed and oriented to increase the magnitude of the resultant force vector $F_1$.

Moreover, the pilot bit section of the bi-center bit includes an extended gage section thereon to lower the force per unit area imposed on the pilot gage pads from the substantially radially aligned resultant lateral force vectors $F_1$ and $F_2$, and particularly the overwhelmingly dominant vector $F_2$ of the reamer bit section. This extended gage section, with its increased (relative to prior art bi-center bits) gage pad surface area, reduces or eliminates the tendency of the pilot bit to drill an out-of-round or over-gage pilot borehole, thus confining the reamer bit section to a desired path dictated by the round, drilled-to-gage pilot borehole and ensuring a drilled-to-gage reamed borehole.

DETAILED DESCRIPTION OF THE PREFERRED EMBODIMENT

Figure 1:
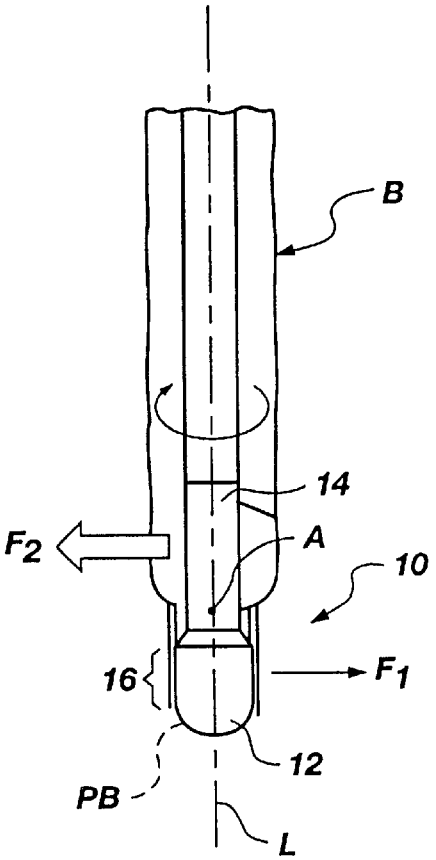
Fig. 1 (PRIOR ART)
FIG. 1 comprises a schematic side elevation of a prior art bi-center bit, indicating the general directions and relative magnitudes of resultant radial force vectors generated by the cutter groups of the pilot bit section and reamer bit section.
Figure 2:
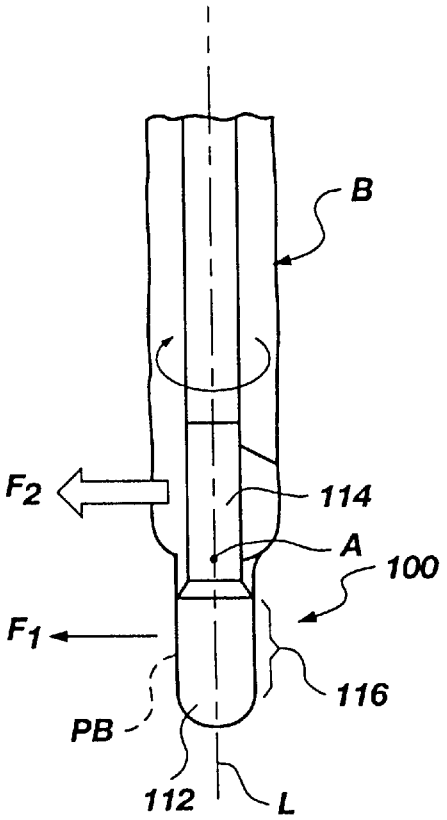
FIG. 2 comprises a schematic side elevation indicating the general directions and relative magnitudes of resultant radial force vectors generated by the pilot bit and reamer bit cutter groups of a bi-center bit according to the present invention.

Referring now to FIG. 2 of the drawings, a bi-center bit 100 according to the present invention is depicted in borehole B. The cutters on the pilot bit section 112 have been placed and oriented (in terms of siderake and backrake) to produce a resultant lateral or radial force vector $F_1$ which is in substantial circumferential alignment with the much larger resultant lateral or radial force vector $F_2$ generated by reamer bit section 114. Thus, the substantially aligned and longitudinally separated resultant lateral or radial force vectors $F_1$ and $F_2$ tend to press bit 100 against the sidewall of the borehole B in the same direction, minimizing the tendency of bit 100 to tilt or cock about horizontal axis A lying between the vectors. While the direction of the aligned force vectors will vary as the bit rotates, the same circumferential side area of the bit 100, and particularly of pilot bit section 112, will ride along the sidewall of borehole B. To accommodate the focused lateral force on the bit 100, and particularly on the gage of pilot bit section 112, the pilot bit section includes extended gage pads providing enhanced gage pad area 116, at least in a location generally radially opposed to the direction of force vectors $F_1$ and $F_2$ and preferably located to extend circumferentially to each side of a radial bit force vector of which $F_1$ and $F_2$ are the components, such bit force vector lying somewhere between $F_1$ and $F_2$, and generally closer to $F_2$ due to its dominance. Thus, pilot borehole PB will remain round and of intended pilot gage.

Figure 3:
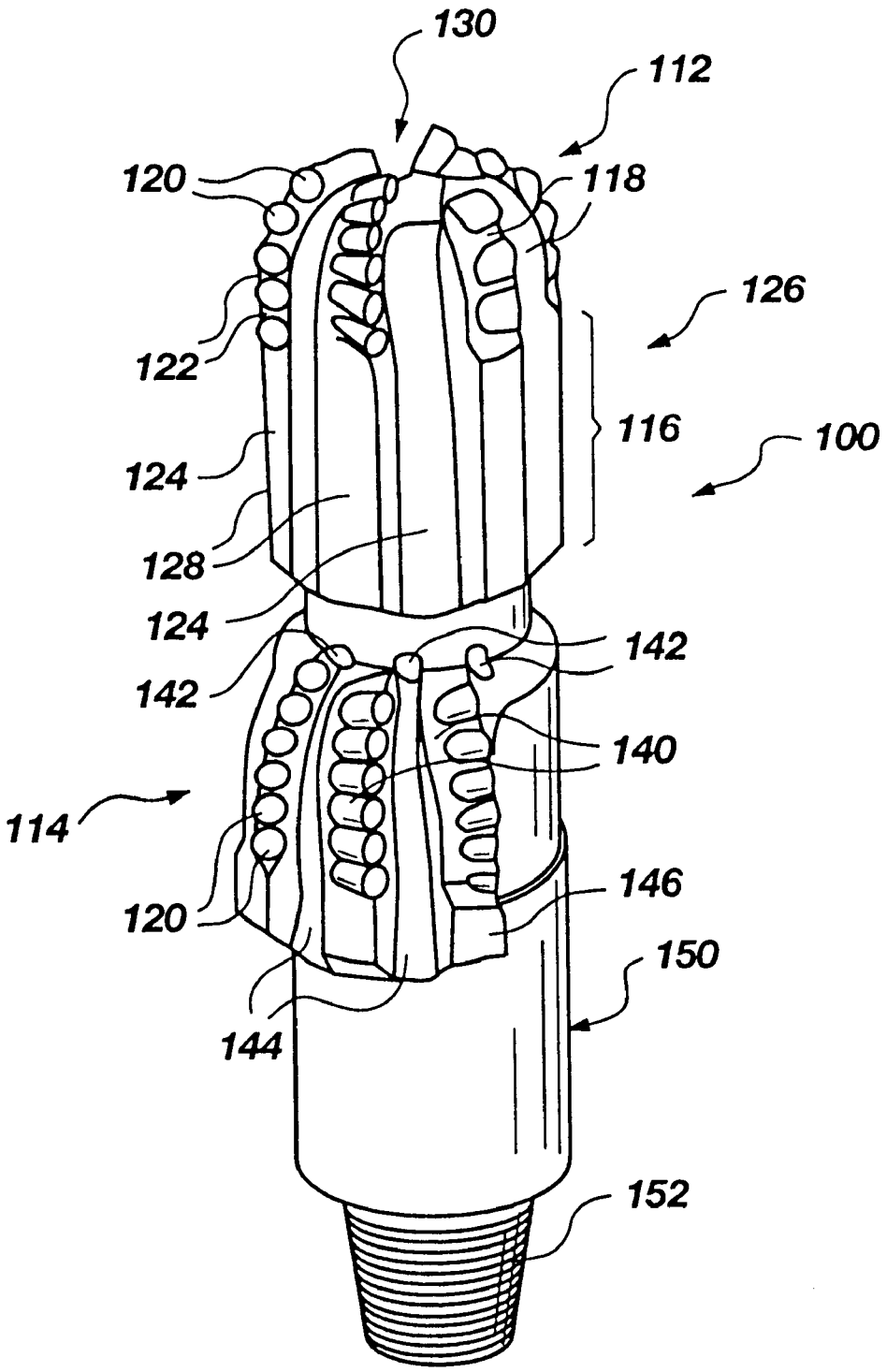
FIG. 3 comprises a perspective side view of a bi-center bit in accordance with the present invention, shown in an inverted position for clarity.

Referring to FIG. 3 of the drawings and noting that the depicted bit has been inverted from its normal drilling orientation for clarity, an exemplary bi-center bit 100 includes a pilot bit section 112 comprising a plurality of blades 118 having superabrasive, preferably polycrystalline diamond compact (PDC) cutters 120 mounted thereto. Fluid courses 122 extending between blades 118 carry drilling fluid laden with cuttings sheared by cutters 120 of blades 118 drilling the pilot borehole into junk slots 124, which extend longitudinally on gage 126 of the bit between elongated gage pads 128. Gage pads 128 are preferably provided with a wearresistant gage surface in the form of tungsten carbide bricks, natural diamonds, diamond-grit impregnated carbide, or a combination thereof, as known in the art, and provide the previously-referenced enhanced gage pad area 116. Drilling fluid is introduced into fluid courses 122 from ports 132 (see FIG. 4) on the bit face 130.

Bit 100 also includes reamer bit section 114 comprising a plurality of blades 140 preferably having PDC cutters 120 mounted thereto. As can be seen in FIG. 3, blades 140 comprise only three in number, and are all located to one side of reamer bit section 114, thus generating previously-referenced dominant lateral force vector $F_2$. Ports 142, located immediately above blades 140, feed drilling fluid into fluid courses 144 located in front of (in the direction of bit rotation) blades 140 to carry away formation cuttings sheared by cutters 120 of blades 140 when enlarging the pilot borehole to full gage diameter. Blades 140 include truncated gage pads 146, which may also preferably include a wear-resistant surface of the types previously mentioned.

Bit shank 150 having a threaded pin connection 152 is used to connect bit 100 to a drill collar or to an output shaft of a downhole motor, as known in the art.

Figure 4:
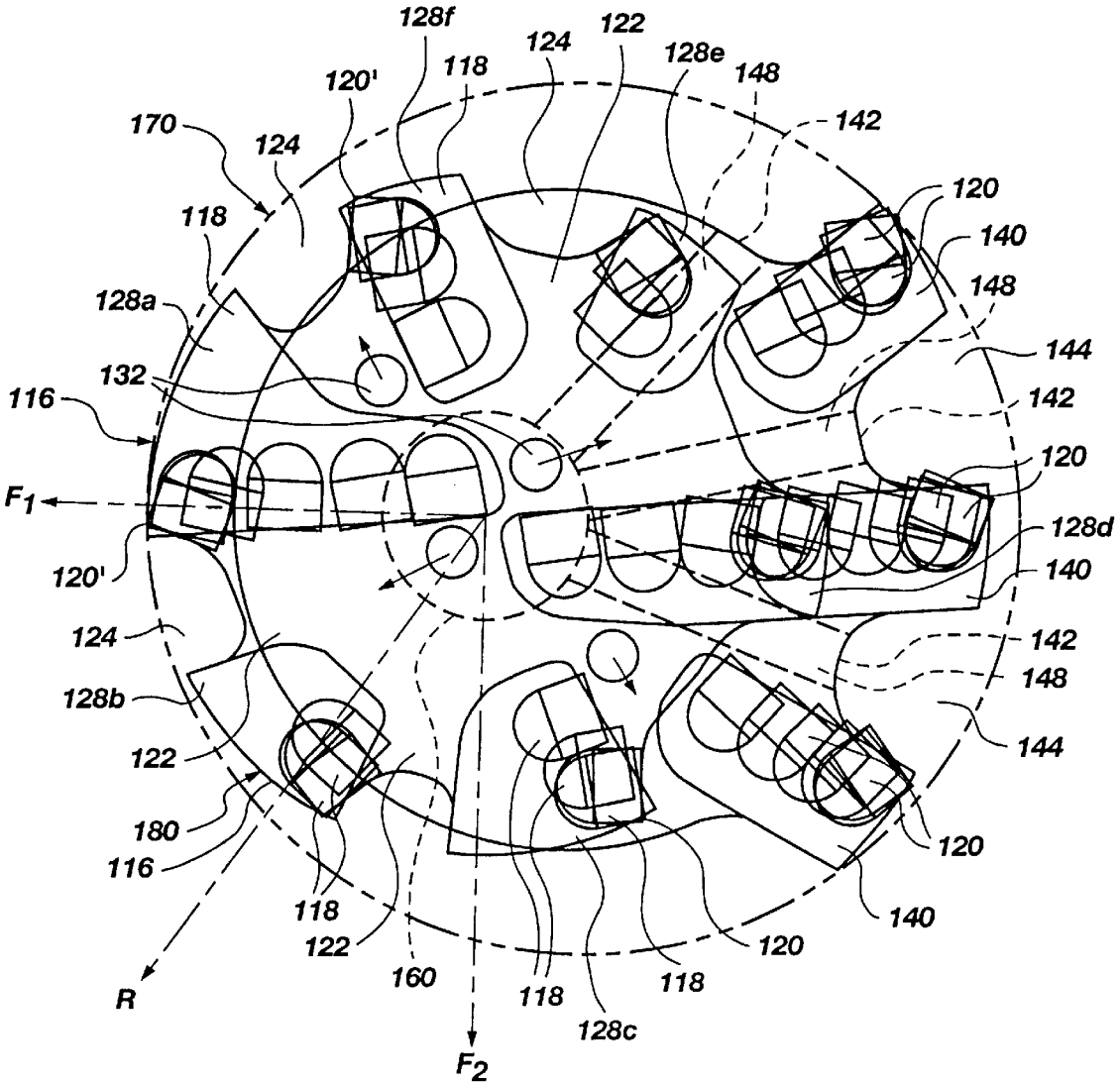
FIG. 4 comprises a face view, or view looking up from the bottom of a borehole, of the cross-sectional configuration and cutter placement of the bit depicted in FIG. 3.
Figure 5:
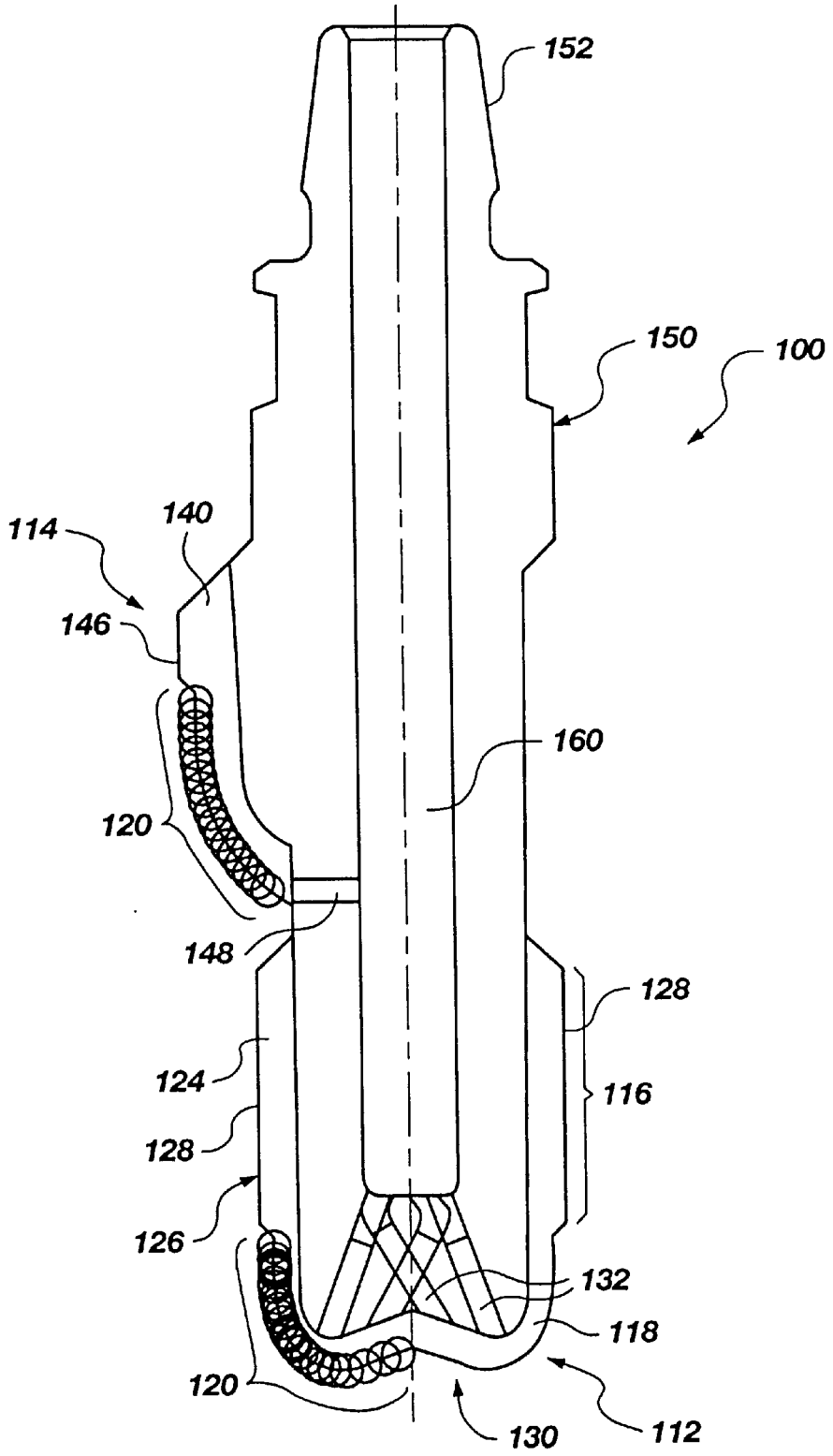
FIG. 5 comprises a side view of the bi-center bit of FIG. 3, showing radial cutter placement on the pilot bit and reamer bit sections, as well as the elongated gage section of the pilot bit section.

Referring now to FIGS. 4 and 5 of the drawings, elements of bit 100 which have been previously described in FIG. 3 are identified by like reference numerals for clarity. As can be seen from FIG. 4, pilot bit section 112 includes six blades 118 thereon, the cutters 120 of which have been placed and oriented to generate a lateral force vector $F_1$ substantially in directional alignment with dominant lateral force vector $F_2$ of reamer bit section. It is preferred that the two lateral force vectors each be substantially radial in direction, passing substantially through the longitudinal axis of the pilot bit section 112, and lying at least within plus or minus 90° of perfect mutual circumferential alignment. As used herein, the term "circumferential" means the location, with respect to the 360° of a circle, and transverse to the longitudinal axis of the bit, wherein a force vector such as $F_1$, $F_2$ or R (see below) is pointed or oriented. Preferably, the force vectors $F_1$ and $F_2$ lie within plus or minus 60° of perfect circumferential alignment and, even more preferably, within plus or minus 45° of perfect circumferential alignment. As noted previously, ideally force vectors $F_1$ and $F_2$ lie on top of one another, looking downward along the axis of the bit 100. Gage pads 128*a,* 128*b* and 128*c,* as well as being of elongated design, are also of expanded circumferential extent in comparison to pads 128*d,* 128*e* and 128*f,* thus further enhancing the bearing surface area of the pilot bit gage 126 in general opposition to the force vectors $F_1$ and $F_2$. FIG. 4 includes exemplary radial force vectors $F_1$ and $F_2$ denoted thereon, as well as resultant radial bit force vector R lying therebetween, oriented circumferentially somewhat closer to vector $F_2$, which comprises the dominant part thereof. Bit vector R passes through gage pad 128*b,* while gage pads 128*a* and 128*c* lie circumferentially to either side thereof, the three gage pads 128*a*–128*c* thus providing enhanced contact area over any likely range of directional variances of bit vector R due to changing borehole or drillstring conditions.

Ports 132, which preferably contain nozzles (not shown) as known in the art, direct drilling fluid, as shown by the arrows associated therewith, into fluid courses 122 of bit face 130. Likewise, passages 148 feed drilling fluid to ports 142 from a central passage or plenum 160, which also feeds face ports 132.

For the sake of clarity, the pass-through diameter of the bit 100 has been shown in FIG. 4 as a broken, circular line 170. Pilot bit gage diameter is defined by the gage cutters 120' at the periphery of bit face 130, and thus corresponds generally to (but is nominally larger than) a circle defined by connecting the radially outer pad surfaces of gage pads 128.

The features of FIG. 5 having already been described with respect to prior drawing figures, no further explanation thereof is believed to be necessary. However, FIG. 5 clearly shows the elongated nature of the pilot bit gage pads 128 and enhanced gage pad area 116. It is preferable that the surface area of these pads, in the area opposing aligned force vectors $F_1$ and $F_2$, comprises sufficient area so that the force sustained thereby does not exceed about three hundred pounds per square inch (300 lb/in.$^2$) of pad area contacting the borehole sidewall. It is preferable that the gage pads be sized and placed to provide such pad area over a range extending plus or minus 90° circumferentially of the aforementioned radial bit resulting force vector, of which $F_1$ and $F_2$ are the components. As implied above, the more closely $F_1$ and $F_2$ are aligned, the smaller the circumferential extent of gage need be provided with this enhanced contact area. Thus, the greater the directional focus and stability of the resulting force vector, the more junk slot area for fluid flow and cuttings removal may be provided on the pilot bit gage. It has been determined that such a surface area is adequate to reduce any significant tendency of pilot bit section 112 to wobble or whirl and, consequently, to drill the aforementioned oversize or out-of-round pilot borehole.

As noted, gage pads 128*a*–*c* opposing force vectors $F_1$ and $F_2$ (as manifested by resultant bit vector R) are circumferentially enlarged to resemble the bearing pads of the previously-mentioned antiwhirl drill bits, and the circumferential positions of blades 118 (rotationally about pilot bit section 112) may be further altered in accordance with more radical anti-whirl designs, as known in the art, if the magnitude of force vector $F_1$ is to be increased.

While the bi-center bit according to the present invention has been disclosed herein with reference to an illustrated embodiment, those of ordinary skill in the art will understand and appreciate that the invention is not so limited, and that additions, deletions and modifications to the disclosed embodiment may be made without departing from the scope of the invention.

What is claimed is:

1. A bi-center drill bit for drilling subterranean formations, comprising:

a pilot bit section having a longitudinal axis, defining a first gage diameter and carrying a first cutting structure thereon placed and oriented to generate a first resultant lateral force vector when rotationally engaging a subterranean formation, said pilot bit section comprising at least one of elongated gage pad providing at least one bearing surface located at least generally opposed to said first resultant lateral force vector; and a reamer bit section adjacent said pilot bit section comprising at least one fixed blade extending radially beyond said first gage diameter along a minor portion of a side periphery of said drill bit and carrying a second cutting structure, said second cutting structure placed and oriented to generate a second resultant lateral force vector when rotationally engaging said subterranean formation;

said first cutting structure being placed and oriented to generate said first resultant lateral force vector in substantial alignment with said second resultant lateral force vector.

2. The bi-center drill bit of claim 1, wherein said first and second resultant lateral force vectors comprise substantially radial force vectors.

3. The bi-center drill bit of claim 1, wherein said second resultant lateral force vector is of greater magnitude than said first resultant lateral force vector.

4. The bi-center drill bit of claim 1, wherein said pilot bit section comprises a fixed-cutter, or drag, bit and said first cutting structure comprises a plurality of superabrasive cutters.

5. The bi-center drill bit of claim 1, wherein said first and second cutting structures each comprise a plurality of superabrasive cutters.

6. The bi-center drill bit of claim 1, wherein said at least one fixed blade of said reamer bit section comprises a plurality of substantially radially-extending, circumferentially spaced, eccentrically placed blades and said second cutting structure comprises at least one superabrasive cutter on each of said plurality of substantially radially-extending, circumferentially spaced, eccentrically placed blades.

7. The bi-center drill bit of claim 1, wherein said pilot bit section includes a face carrying said first cutting structure and a gage section extending longitudinally from an outer periphery of said face and comprising said at least one elongated gage pad.

8. The bi-center drill bit of claim 7, wherein said at least one elongated gage pad comprises a plurality of elongated gage pads providing greater bearing surface area on a portion of said gage section generally radially opposing said substantially laterally aligned first and second lateral force vectors than elsewhere on said gage section.

9. The bi-center drill bit of claim 8, wherein said plurality of elongated gage pads are of sufficient area to limit pressure thereon during contact with a sidewall of a borehole being drilled to no greater than about 300 lb/in.$^2$.

10. The bi-center drill bit of claim 8, wherein said first and second resultant lateral force vectors comprise components of a resultant bit force vector oriented therebetween, and wherein said greater bearing surface area is sized and located on said pilot bit section to provide coverage within plus or minus 90° circumferentially of said resultant bit force vector.

11. The bi-center drill bit of claim 7, wherein said plurality of elongated gage pads comprise a plurality of elongated, circumferentially spaced gage pads separated by longitudinally extending junk slots.

12. The bi-center drill bit of claim 1, wherein said first cutting structure is placed and oriented on said pilot bit section for enhancement of the magnitude of said first resultant lateral force vector and for the circumferential alignment of said first resultant lateral force vector with said second resultant lateral force vector, said circumferential alignment ranging from substantial mutual superimposition to plus or minus 90° of substantial mutual circumferential alignment.

13. A bi-center drill bit for drilling subterranean formations, comprising:

a pilot drag bit section having a longitudinal axis, defining a first gage diameter and including a body with a face having a first plurality of superabrasive cutters secured thereto and a gage section extending longitudinally from a periphery of said face and comprising a plurality of elongated gage pads; and a reamer bit section adjacent said pilot drag bit section including at least one blade fixedly extending radially beyond said first gage diameter on one peripheral side portion of said bit and carrying a second plurality of superabrasive cutters thereon;

said first plurality of superabrasive cutters being placed and oriented on said pilot drag bit section face to generate, upon rotation of said bi-center bit in engagement with a subterranean formation, a lateral force on said pilot drag bit section in substantial alignment with a lateral force generated by said second plurality of superabrasive cutters responsive to said rotation, said plurality of elongated gage pads being circumferentially extended to generally oppose said lateral forces.

14. The bi-center drill bit of claim 13, wherein said lateral forces comprise substantially radial forces.

15. The bi-center drill bit of claim 13, wherein said lateral force generated by said second plurality of superabrasive cutters is of greater magnitude than said lateral force generated by said first plurality of superabrasive cutters.

16. The bi-center drill bit of claim 13, wherein said superabrasive cutters comprise polycrystalline diamond cutters.

17. The bi-center drill bit of claim 13, wherein said at least one blade comprises a plurality of circumferentially spaced blades.

18. The bi-center drill bit of claim 13, wherein said plurality of elongated gage pads of said gage section are circumferentially and longitudinally extended to provide at least one enhanced bearing area radially opposed to said lateral forces.

19. The bi-center drill bit of claim 18, wherein said plurality of elongated gage pads provide greater surface area on a portion of said at least one enhanced gage pad area of said gage section generally radially opposing said substantially aligned lateral forces than elsewhere on said gage section.

20. The bi-center drill bit of claim 19, wherein said greater gage pad surface area is sufficient to limit pressure thereon during contact with a sidewall of a borehole being drilled to no greater than about 300 lb/in.$^2$.

21. The bi-center drill bit of claim 19, wherein said lateral forces comprise components of a resultant bit force oriented therebetween, and wherein said greater gage pad surface area is sized and located on said pilot drag bit section to provide coverage within plus or minus 90° circumferentially of said resultant bit force.

22. The bi-center drill bit of claim 18, wherein said plurality of elongated gage pads comprise a plurality of circumferentially spaced, longitudinally elongated gage pads separated by longitudinally extending junk slots.

23. The bi-center drill bit of claim 13, wherein said first plurality of cutters is placed and oriented on said pilot drag bit section for enhancement of the magnitude of said lateral force generated thereby and for circumferential alignment of said lateral forces, said circumferential alignment ranging from substantial mutual superimposition to plus or minus 90° of substantial mutual circumferential alignment.

24. A method of drilling a subterranean borehole commencing from the bottom of a first diameter borehole segment and including a second, larger diameter borehole segment extending forward from said first diameter borehole segment, comprising:

orienting and placing a fixed cutting structure on a drill bit in order to orient a first lateral force vector with a second, longitudinally spaced lateral force vector;

rotating said drill bit on an end of a drill string and applying weight to said bit against said first borehole segment bottom to cut a pilot borehole of a diameter smaller than that of said first borehole segment;

substantially concurrently cutting and enlarging said cut pilot borehole to said second, larger diameter borehole with a fixed laterally extended cutting structure on said drill bit while substantially concurrently applying said weight to said drill bit;

transitioning from a pass-through axis to a drilling axis when said fixed laterally extended cutting structure commences enlargement of said cut pilot borehole to said second, larger diameter borehole; and generating said first lateral force vector while cutting said pilot borehole with said oriented and placed fixed cutting structure and said second, longitudinally spaced lateral force vector substantially laterally aligned with said first lateral force vector while enlarging said pilot borehole.

25. The method of claim 24, wherein generating said first lateral force vector and said second, longitudinally spaced lateral force vector comprise generating radial force vectors.

26. The method of claim 24, further comprising passing said drill bit on an end of said drill string through said first diameter borehole segment to the bottom thereof.

27. The method of claim 24, further comprising cutting said pilot borehole with a fixed cutting structure.

28. The method of claim 24, further comprising pressing at least one predetermined gage portion of said bit against a sidewall of said pilot borehole responsive to said first lateral force vector and said second, longitudinally spaced lateral force vector.

29. The method of claim 28, further comprising maintaining a magnitude of force pressing said at least one predetermined gage portion against said pilot borehole sidewall below about 300 lb/in.$^2$ of contact area between said at least one predetermined gage portion and said sidewall.

30. The method of claim 28, wherein said first lateral force vector and said second, longitudinally spaced lateral force vector are components of a resultant bit force vector oriented therebetween, and wherein said at least one predetermined gage portion of said bit is sized and positioned to provide coverage between plus or minus 90° circumferentially of said resultant bit force vector.

31. The method of claim 24, wherein said first lateral force vector and said second, longitudinally spaced lateral force vector are oriented within about plus or minus 90° of perfect mutual circumferential alignment.

32. The method of claim 31, wherein said first lateral force vector and said second, longitudinally spaced lateral force vector are oriented within about plus or minus 60° of perfect mutual circumferential alignment.

33. The method of claim 32, wherein said first lateral force vector and said second, longitudinally spaced lateral force vector are oriented within about plus or minus 45° of perfect mutual circumferential alignment.

34. The method of claim 33, wherein said first lateral force vector and said second, longitudinally spaced lateral force vector are substantially mutually superimposed.

* * * * *

UNITED STATES PATENT AND TRADEMARK OFFICE

CERTIFICATE OF CORRECTION

PATENT NO. : 5,957,223
DATED : September 28, 1999
INVENTOR(S) : Michael L. Doster and Jack T. Oldham It is certified that error appears in the above-identified patent and that said Letters Patent is hereby corrected as shown below:

Title page,
Item [56], References Cited, U.S. PATENT DOCUMENTS, change "Betti" to -- Bettis --, OTHER PUBLICATIONS, change "Bit reduces" to -- Bit Reduces --

Drawings,
FIG. 4, change reference numeral "180" -- 118 --

Column 5,
Line 7, change "wearresistant" to -- wear-resistant --
Line 48, after "ideally" insert -- , --

Column 6,
Line 56, delete "of"

Column 7,
Line 37, change "are" to -- is --
Line 47, change "claim 7," to -- claim 8, --
Line 48, change "comprise" to -- comprises --
Line 53, change "the" to -- a --
Line 54, delete "the"
Line 55, change "with" to -- within --

Column 8,
Line 21, after "said" insert -- first and second plurality of --
Line 28, change "are" to -- is --
Line 33, change "provide" to -- provides --
Line 34, change "gage pad" to -- bearing --
Line 49, change "comprise" to -- comprises --
Line 53, after "of" insert -- superabrasive --
Line 54, change "the" to -- a --
Line 68, after "to said" insert -- drill -- and after "first" insert -- diameter --

UNITED STATES PATENT AND TRADEMARK OFFICE

CERTIFICATE OF CORRECTION

PATENT NO. : 5,957,223
DATED : September 28, 1999
INVENTOR(S) : Michael L. Doster and Jack T. Oldham It is certified that error appears in the above-identified patent and that said Letters Patent is hereby corrected as shown below:

Column 9,
Line 2, after "first" insert -- diameter --
Line 5, after "fixed" insert -- , --
Line 9, after "fixed" insert -- , --
Line 20, change "comprise" to -- comprises --
Line 22, change "an" to -- said --
Line 27, after "said" insert -- drill --

Signed and Sealed this

Sixth Day of August, 2002

*Attest:*

*Attesting Officer*

JAMES E. ROGAN
*Director of the United States Patent and Trademark Office*